US011242820B2

(12) United States Patent
Doi et al.

(10) Patent No.: US 11,242,820 B2
(45) Date of Patent: Feb. 8, 2022

(54) CHAIN COVER

(71) Applicant: TOYOTA BOSHOKU KABUSHIKI KAISHA, Aichi-ken (JP)

(72) Inventors: Kensuke Doi, Obu (JP); Yoji Horiuchi, Kariya (JP); Hideto Morishita, Gifu (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 16/898,755

(22) Filed: Jun. 11, 2020

(65) Prior Publication Data

US 2020/0400095 A1 Dec. 24, 2020

(30) Foreign Application Priority Data

Jun. 21, 2019 (JP) ..... JP2019-115366

(51) Int. Cl.

| | |
|---|---|
| ***F02F 7/00*** | (2006.01) |
| ***F01L 1/02*** | (2006.01) |
| *F02B 77/00* | (2006.01) |

(52) U.S. Cl.

CPC ..... *F02F 7/0065* (2013.01); *F01L 1/022* (2013.01); *F02B 77/00* (2013.01); *F02F 7/008* (2013.01)

(58) Field of Classification Search

CPC ..... F02F 7/0065; F02F 7/008; F02F 11/00; F01L 1/022; F02B 77/00

See application file for complete search history.

(56) References Cited

U.S. PATENT DOCUMENTS

| | | | | |
|---|---|---|---|---|
| 5,692,466 | A * | 12/1997 | Hausmann | F02B 67/10 123/195 A |
| 6,182,625 | B1 * | 2/2001 | Ozeki | F01M 1/02 123/195 C |
| 2014/0137833 | A1 * | 5/2014 | Buehler | F02F 7/00 123/195 C |
| 2014/0224206 | A1 * | 8/2014 | Staley | F02F 7/0073 123/195 C |
| 2017/0101960 | A1 | 4/2017 | Goto | |
| 2017/0107940 | A1 * | 4/2017 | Koiwa | F02F 7/0073 |
| 2017/0292601 | A1 * | 10/2017 | Lee | F16H 57/035 |

FOREIGN PATENT DOCUMENTS

| | | |
|---|---|---|
| CN | 103821635 | 5/2014 |
| CN | 107023416 | 8/2017 |
| JP | 2019-44608 | 3/2019 |

OTHER PUBLICATIONS

China Office Action issued in China Patent Application No. 202010541684.1, dated Oct. 20, 2021, together with English translation thereof.

* cited by examiner

*Primary Examiner* — Syed O Hasan

(74) *Attorney, Agent, or Firm* — Greenblum & Bernstein, P.L.C.

(57) ABSTRACT

A chain cover is configured to cover a timing chain that transmits rotation of a crankshaft of an internal combustion engine to a camshaft. The chain cover includes a crankshaft-side opening forming portion that defines a crankshaft-side opening into which the crankshaft is inserted, and a general portion that is a section different from the crankshaft-side opening forming portion. The crankshaft-side opening forming portion is made of a first material. The general portion is made of a second material. The first material and the second material are different from each other.

7 Claims, 1 Drawing Sheet

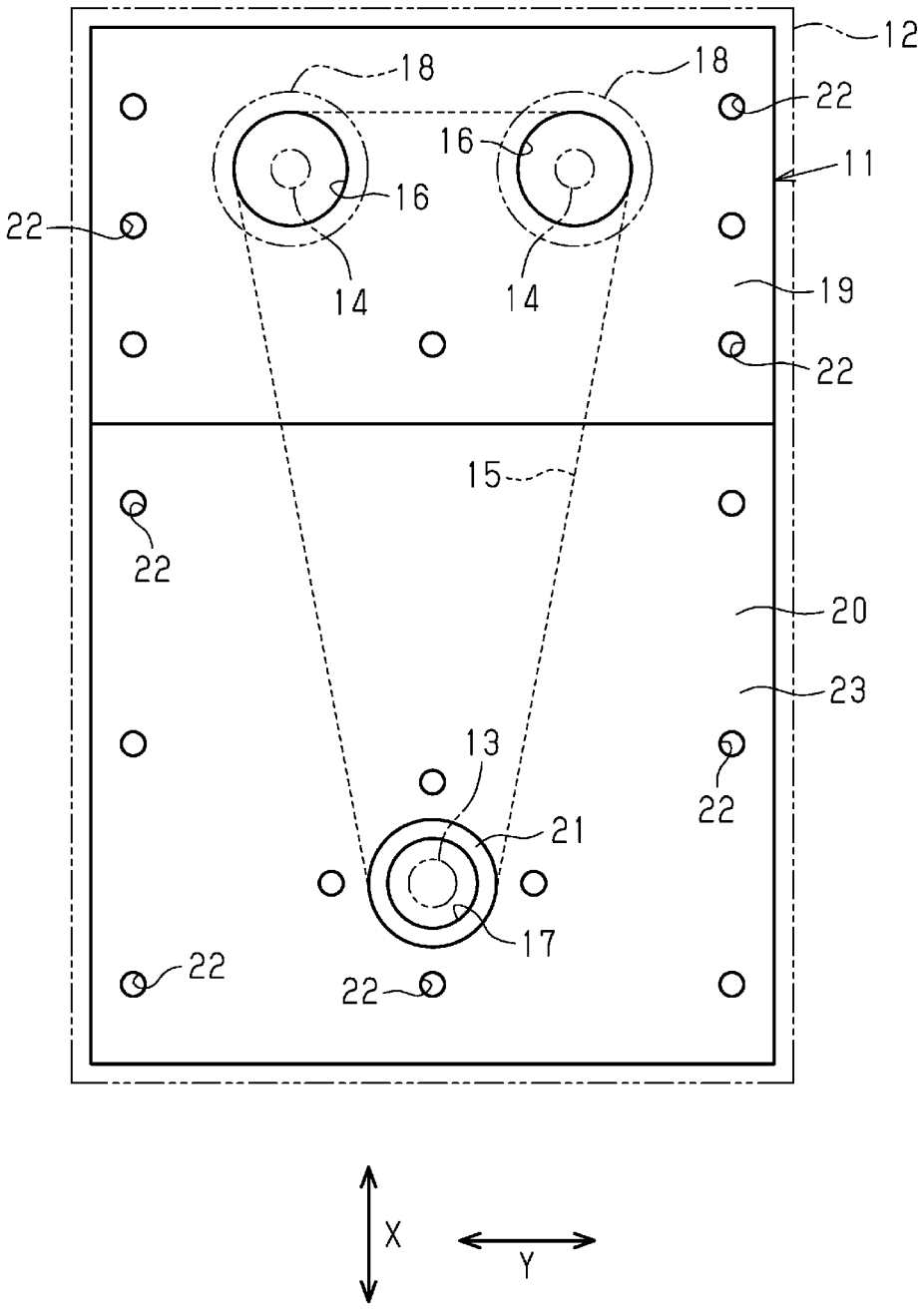
12
18
18
22
16
11
16
22
14
14
19
22
15
22
20
23
13
22
21
17
22
22
X
Y

CHAIN COVER

BACKGROUND

1. Field

The present disclosure relates to a chain cover that is configured to cover a timing chain that transmits rotation of a crankshaft of an internal combustion engine to camshafts.

2. Description of Related Art

Japanese Laid-Open Patent Publication No. 2019-44608 discloses one example of such a chain cover. Typically, such a chain cover is entirely made of a single type of material.

Therefore, when the above-described chain cover requires a high dimensional accuracy in a certain section, the dimensional accuracy of that section may be insufficient.

SUMMARY

It is an objective of the present disclosure to provide a chain cover that is capable of achieving a required dimensional accuracy in a section that requires a high dimensional accuracy.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To achieve the foregoing objective, a chain cover is provided that is configured to cover a timing chain that transmits rotation of a crankshaft of an internal combustion engine to a camshaft. The chain cover includes a crankshaft-side opening forming portion that defines a crankshaft-side opening into which the crankshaft is inserted, and a general portion that is a section different from the crankshaft-side opening forming portion. The crankshaft-side opening forming portion is made of a first material. The general portion is made of a second material. The first material and the second material are different from each other.

Other features and aspects will be apparent from the following detailed description, the drawing, and the claims.

BRIEF DESCRIPTION OF THE DRAWING

FIG. 1 is a schematic front view of a chain cover according to one embodiment.

Throughout the drawing and the detailed description, the same reference numerals refer to the same elements. The drawing may not be to scale, and the relative size, proportions, and depiction of elements in the drawing may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A chain cover 11 according to one embodiment will now be described with reference to the drawing.

As shown in FIG. 1, the chain cover 11 has a rectangular shape extending in a vertical direction. The chain cover 11 is attached to an internal combustion engine 12 so as to cover a timing chain 15 that transmits rotation of a crankshaft 13 of the internal combustion engine 12 to a pair of camshafts 14. The chain cover 11 has a pair of circular camshaft-side openings 16, which receive the respective camshafts 14, and a circular crankshaft-side opening 17, which receives the crankshaft 13.

A longitudinal direction X of the chain cover 11 matches the vertical direction. A traverse direction Y of the chain cover 11 is thus orthogonal to the vertical direction. The camshaft-side openings 16 are disposed in an upper end of the chain cover 11 with a distance in between in the traverse direction Y. In this case, the camshaft-side openings 16 are disposed on the opposite sides of the center of the chain cover 11 in the traverse direction Y. The crankshaft-side opening 17 is disposed in a lower end of the chain cover 11 at the center in the traverse direction Y.

Two cam timing control units 18 are provided at distal ends of the respective camshafts 14, which are inserted into the camshaft-side openings 16. Each cam timing control unit 18 is disposed to cover the corresponding camshaft-side opening 16 from the outside. The cam timing control unit 18 controls rotation angles of cams (not shown) provided on the camshaft 14 relative to rotation of the crankshaft 13.

The chain cover 11 has an upper region 19, which includes sections defining the two camshaft-side openings 16. The upper region 19 is made of a first plastic material. That is, the material of the sections defining the camshaft-side openings 16 (third material) is the first plastic material. The region except the upper region 19 of the chain cover 11, or the region from the center to the lower section, is a middle-to-lower region 20.

The middle-to-lower region 20 of the chain cover 11 includes an annular crankshaft-side opening forming portion 21, which defines the crankshaft-side opening 17, and a general portion 23, which is different from the crankshaft-side opening forming portion 21. That is, the middle-to-lower region 20 includes the crankshaft-side opening forming portion 21, which forms the crankshaft-side opening 17, and the general portion 23, which is the section except the crankshaft-side opening forming portion 21.

The general portion 23 is made of a second plastic material. The crankshaft-side opening forming portion 21 is made of a metal material. Thus, the material that forms the crankshaft-side opening forming portion 21 (first material) is different from the material that forms the general portion 23 (second material). In the present embodiment, the material that forms the crankshaft-side opening forming portion 21 (first material) is aluminum. Thus, the material of the sections defining the camshaft-side openings 16 (third material) is different from the material that forms the general portion 23 (second material).

The first plastic material, which is the material of the sections defining the camshaft-side openings 16 (third material), has a lower coefficient of linear expansion and a lower water absorbency than the second plastic material, which is the material forming the general portion 23 (second material). In the present embodiment, polyphenylenesulfide (PPS) is used as the first plastic material, and a plastic material that contains polyamide (PA) as a major component is used as the second plastic material.

The chain cover 11 has multiple fixing holes 22, which are one example of fixing portion that is used to fix the chain cover 11 to the internal combustion engine 12. The chain cover 11 is fixed to the internal combustion engine 12 with bolts (not shown), which are inserted into the fixing holes 22. Many of the fixing holes 22 are disposed in the opposite ends of the chain cover 11 in the traverse direction Y and about the crankshaft-side opening 17. The region of the chain cover 11 that includes the sections defining the camshaft-side openings 16 and is made of the material that forms the sections (third material), that is, the upper region 19 of the chain cover 11, has at least some of the fixing holes 22 that are disposed on opposite sides of the two camshaft-side openings 16 in the traverse direction Y.

The operation of the chain cover 11 will now be described.

Since the crankshaft 13 is inserted into the crankshaft-side opening 17 in the middle-to-lower region 20 of the chain cover 11, it is advantageous that the dimensional accuracy of the section defining the crankshaft-side opening 17 is as high as possible. In this respect, the section defining the crankshaft-side opening 17 of the present embodiment is formed by the crankshaft-side opening forming portion 21, which is made of metal, and the crankshaft 13 is inserted into the crankshaft-side opening forming portion 21.

The crankshaft-side opening forming portion 21, which is made of metal, has a coefficient of linear expansion that is significantly lower than that of the second plastic material, which forms the general portion 23. Thus, the change in the inner diameter of the crankshaft-side opening forming portion 21 due to a change in temperature is significantly smaller than that in a case of the second plastic material. Therefore, the crankshaft-side opening forming portion 21 is prevented from contacting the crankshaft 13 when the position of the crankshaft-side opening forming portion 21 is displaced to some extent by small changes in the dimension of the general portion 23 due to water absorption and temperature changes of the second plastic material.

The cam timing control units 18 are attached to the distal ends of the camshafts 14, which are inserted into the camshaft-side openings 16 of the chain cover 11. The cam timing control units 18 cover the camshaft-side openings 16 from the outside. Thus, in order to maintain the control accuracy of the cam timing control units 18, it is advantageous that the position-maintaining performance of the sections of the chain cover 11 that define the camshaft-side openings 16 is as high as possible.

In this regard, in the present embodiment, the upper region 19, which includes the sections defining the camshaft-side openings 16, is made of the first plastic material, which has a lower coefficient of linear expansion and a lower water absorbency than the second plastic material, which forms the general portion 23. Thus, since the first plastic material, which forms the upper region 19, is unlikely to be influenced by water in the environment or temperature changes, the dimensional change of the first plastic material is smaller than that of the second plastic material, which forms the general portion 23.

Further, the upper region 19 has at least some of the fixing holes 22, which receive bolts (not shown) for fixing the chain cover 11 to the internal combustion engine 12, and these fixing holes 22 are located on the opposite sides of the camshaft-side openings 16 in the traverse direction Y. That is, the upper region 19, which is made of the first plastic material, is directly fixed to the internal combustion engine 12. This improves the position-maintaining performance of the sections of the upper region 19 that define the camshaft-side openings 16. That is, the position-maintaining performance of the cam timing control units 18 is improved.

As described above, in the chain cover 11, the material that forms the general portion 23 (second material) is different from the material that forms the upper region 19, which includes the sections defining the camshaft-side openings 16 (third material), and the material that forms the crankshaft-side opening forming portion 21 (first material). That is, the third material, which forms the upper region 19, and the first material, which forms the crankshaft-side opening forming portion 21, have higher dimensional accuracies than the second material, which forms the general portion 23. This allows the upper region 19 and the crankshaft-side opening forming portion 21, which are sections of the chain cover 11 that require high dimensional accuracies, to attain the required dimensional accuracies. Since the section of the chain cover 11 that forms the general portion 23 does not require a high dimensional accuracy, a sufficient dimensional accuracy is achieved even if the section is made of the second plastic material.

The above-described embodiment achieves the following advantages.

(1) In the chain cover 11, the material that forms the crankshaft-side opening forming portion 21, which defines the crankshaft-side opening 17 (first material) is different from the material that forms the general portion 23 (second material). In general, the section of the chain cover 11 that defines the crankshaft-side opening 17 requires a high dimensional accuracy, while the section that forms the general portion 23 does not require a high dimensional accuracy. In this respect, with the configuration of the present embodiment, the first material, which forms the crankshaft-side opening forming portion 21, is different from the second material, which forms the general portion 23. This allows a material having a high dimensional accuracy to be used only for the crankshaft-side opening forming portion 21, which defines the crankshaft-side opening 17. The sections of the chain cover 11 that require high dimensional accuracies thus may attain the required dimensional accuracies.

(2) The chain cover 11 has the two camshaft-side openings 16, which receive the camshafts 14. The material of the sections of the chain cover 11 that define the camshaft-side openings 16 (third material) is different from the material that forms the general portion 23 (second material). In general, the sections of the chain cover 11 that define the camshaft-side openings 16 require a high dimensional accuracy, while the section that forms the general portion 23 does not require a high dimensional accuracy. In this respect, with the configuration of the present embodiment, the third material, which forms the sections defining the camshaft-side openings 16, is different from the second material, which forms the general portion 23. This allows a material having a high dimensional accuracy to be used only for the sections defining the camshaft-side openings 16. The sections of the chain cover 11 that require high accuracies thus may attain the required dimensional accuracies.

(3) In the chain cover 11, the material of the sections defining the camshaft-side openings 16 (third material) has a lower coefficient of linear expansion than that of the material that forms the general portion 23 (second material). With this configuration, dimensional changes of the sections defining the camshaft-side openings 16 are smaller than those of the section defining the general portion 23. This allows the sections defining the camshaft-side openings 16 to have a higher position-maintaining performance than the section defining the general portion 23.

(4) In the chain cover 11, the material of the sections defining the camshaft-side openings 16 (third material) has a lower water absorbency than that of the material that forms the general portion 23 (second material). With this configuration, the dimensional changes of the sections defining the camshaft-side openings 16 are smaller than those of the section defining the general portion 23. This allows the sections defining the camshaft-side openings 16 to have a higher position-maintaining performance than the section defining the general portion 23.

(5) In the chain cover 11, the first material forms the crankshaft-side opening forming portion 21, which defines the crankshaft-side opening 17. The second material forms the general portion 23. The third material forms the sections defining the camshaft-side openings 16. Among the first, second, and third materials, the second and the third materials are plastic materials. This configuration reduces the weight of the chain cover 11 as compared to a case in which one of the second material, which forms the general portion 23, and the third material, which forms the sections defining the camshaft-side openings 16, is a metal material.

(6) At least some of the fixing holes 22, which are used to fix the chain cover 11 to the internal combustion engine 12 with bolts (not shown), are provided in the region of the chain cover 11 that includes the sections defining the camshaft-side openings 16 and is made of the material that forms the sections (third material). In this region, the fixing holes 22 are disposed on the opposite sides of the two camshaft-side openings 16 in the traverse direction Y. This configuration allows the region to be directly fixed to the internal combustion engine 12 with the bolts (not shown) at the fixing holes 22. Accordingly, the position-maintaining performance of the sections defining the camshaft-side openings 16 is improved.

Modifications

The above-described embodiment may be modified as follows. The above-described embodiment and the following modifications can be combined as long as the combined modifications remain technically consistent with each other.

At least some of the fixing holes 22 do not necessarily need to be disposed on the opposite sides of the two camshaft-side openings 16 in the traverse direction Y in the region of the chain cover 11 that includes the sections defining the camshaft-side openings 16 and is made of the material that forms the sections (third material).

In the chain cover 11, the number and positions of the fixing holes 22 may be changed.

In the chain cover 11, the material of the sections defining the camshaft-side openings 16 (third material) does not necessarily need to have a lower water absorbency than the material that forms the general portion 23 (second material).

In the chain cover 11, the material of the sections defining the camshaft-side openings 16 (third material) does not necessarily need to have a lower coefficient of linear expansion than the material that forms the general portion 23 (second material).

In the chain cover 11, at least one of the material of the sections defining the camshaft-side openings 16 (third material) and the material that forms the general portion 23 (second material) may be changed to a metal material.

In the chain cover 11, the material that forms the section defining the crankshaft-side opening 17 (crankshaft-side opening forming portion 21) (first material) may be changed to a plastic material.

In the chain cover 11, at least one of the camshaft-side openings 16 may be omitted.

The material of the section of the chain cover 11 that define the camshaft-side openings 16 (third material) may be the same as the material that forms the general portion 23 (second material).

In the chain cover 11, the polyphenylenesulfide (PPS) is used as the first plastic material. In place of polyphenylenesulfide (PPS), it is possible to use liquid crystal polymer (LCP), polyetheretherketone (PEEK), polyethylene naphthalate (PEN), polyamide 6T (PA6T), polyamide 9T (PA9T), polybutyleneterephtalate (PBT), or polyacetal (POM).

The shape of the chain cover 11 may be changed.

In the chain cover 11, the diameters of the camshaft-side openings 16 and the crankshaft-side opening 17 may be changed.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A chain cover that is configured to cover a timing chain that transmits rotation of a crankshaft of an internal combustion engine to a camshaft, the chain cover comprising:

a crankshaft-side opening forming portion that defines a crankshaft-side opening into which the crankshaft is inserted; and a general portion that is a section different from the crankshaft-side opening forming portion, wherein the crankshaft-side opening forming portion is made of a first material, the general portion is made of a second material, the first material and the second material are different from each other, the chain cover includes a camshaft-side opening into which the camshaft is inserted, a section of the chain cover that defines the camshaft-side opening is made of a third material, and the third material is different from both the first material and the second material.

2. The chain cover according to claim 1, wherein the third material has a lower coefficient of linear expansion than the second material.

3. The chain cover according to claim 1, wherein the third material has a lower water absorbency than the second material.

4. The chain cover according to claim 1, wherein at least one of the first material, the second material, and the third material is a plastic material.

5. The chain cover according to claim 1, comprising fixing portions used to fix the chain cover to the internal combustion engine, wherein the fixing portions are provided in a region of the chain cover that includes the section defining the camshaft-side opening and is made of the third material, and the fixing portions are located on opposite sides of the camshaft-side opening.

6. The chain cover according to claim 1, wherein
the first material is a metal material,
the third material is a first plastic material,
the second material is a second plastic material, and
the first plastic material has a lower coefficient of linear expansion than the second plastic material.

7. The chain cover according to claim 1, wherein
the first material is a metal material,
the third material is a first plastic material,
the second material is a second plastic material, and
the first plastic material has a lower water absorbency than the second plastic material.

* * * * *